US009999305B1

(12) United States Patent
Dryer et al.

(10) Patent No.: US 9,999,305 B1
(45) Date of Patent: Jun. 19, 2018

(54) SLIP COVER FOR AN OUTDOOR, COLLAPSIBLE CHAIR

(71) Applicants: Peter Dryer, Yuma, AZ (US); Joyce Dryer, Yuma, AZ (US)

(72) Inventors: Peter Dryer, Yuma, AZ (US); Joyce Dryer, Yuma, AZ (US)

( * ) Notice: Subject to any disclaimer, the term of this patent is extended or adjusted under 35 U.S.C. 154(b) by 262 days.

(21) Appl. No.: 15/083,530

(22) Filed: Mar. 29, 2016

(51) Int. Cl.

| | |
|---|---|
| ***A47C 7/66*** | (2006.01) |
| ***A47C 4/00*** | (2006.01) |
| ***A47C 1/14*** | (2006.01) |
| ***A47C 7/62*** | (2006.01) |

(52) U.S. Cl.
CPC ..... *A47C 7/66* (2013.01); *A47C 1/14* (2013.01); *A47C 4/00* (2013.01); *A47C 7/62* (2013.01)

(58) Field of Classification Search
CPC ..... A47G 9/062; A47C 7/66; A47C 7/004; B60N 2/60; B60N 2/609; B60N 2/6009
See application file for complete search history.

(56) References Cited

U.S. PATENT DOCUMENTS

| | | | | | |
|---|---|---|---|---|---|
| 1,519,741 | A * | 12/1924 | Schickerling | B60N 2/6009 | 2/69 |
| 2,904,103 | A * | 9/1959 | Nail | B60N 2/60 | 297/224 |
| 4,838,610 | A * | 6/1989 | Perrin | A47C 31/11 | 297/225 |
| 5,294,166 | A * | 3/1994 | Shapland | B60N 2/6009 | 296/97.23 |
| 5,320,407 | A * | 6/1994 | Tell | A47C 31/11 | 297/225 |
| 5,781,946 | A | 7/1998 | McEntire | | |
| 5,950,261 | A | 9/1999 | Hay | | |
| 6,036,260 | A * | 3/2000 | Mullen | B60N 2/6036 | 2/69.5 |
| 6,393,638 | B1 * | 5/2002 | MacColl | A45F 4/02 | 383/4 |
| 6,764,134 | B1 | 7/2004 | Crescenzi | | |
| 6,832,812 | B2 * | 12/2004 | Riley | A47C 31/11 | 24/326 |
| 7,506,927 | B1 | 3/2009 | Williams | | |
| 7,581,259 | B2 | 9/2009 | Thompson | | |
| D685,594 | S | 7/2013 | Crookes | | |
| 8,733,837 | B2 * | 5/2014 | Weinstein | A47C 31/113 | 297/228 |
| 8,979,192 | B2 | 3/2015 | Miller | | |

(Continued)

FOREIGN PATENT DOCUMENTS

CA 2754377 A1 4/2012

*Primary Examiner* — Timothy J Brindley

(57) ABSTRACT

The slip cover for an outdoor collapsible chair is adapted for use with a chair. The slip cover for an outdoor collapsible chair is designed to drape over a chair in a manner that provides a clean top surface upon which the user can sit. The slip cover for an outdoor collapsible chair is designed to be able to be folded on to the user. Optionally, the slip cover for an outdoor collapsible chair can further comprises a plurality of pockets such that when the slip cover for an outdoor collapsible chair is folded on the user the plurality of pockets are accessible. As a further option, the slip cover for an outdoor collapsible chair can be formed from a water resistant insulated textiles that is suitable for blankets. The slip cover for an outdoor collapsible chair comprises a plurality of panels and a plurality of sewn seams.

11 Claims, 4 Drawing Sheets

(56) References Cited

U.S. PATENT DOCUMENTS

| | | | | |
|---|---|---|---|---|
| 2006/0117455 | A1 | 6/2006 | Park | |
| 2006/0169690 | A1* | 8/2006 | Rothschild | A45C 7/0036 220/7 |
| 2010/0066131 | A1* | 3/2010 | Smith | A47C 4/286 297/16.1 |
| 2010/0263122 | A1* | 10/2010 | Papen | A47D 15/003 5/502 |
| 2012/0193958 | A1* | 8/2012 | DePasquale | A47C 31/11 297/228.11 |
| 2012/0272454 | A1* | 11/2012 | Warner | A47G 9/062 5/652 |
| 2015/0113730 | A1* | 4/2015 | Wentland | A47G 9/062 5/417 |
| 2016/0288679 | A1* | 10/2016 | White | B60N 2/6009 |
| 2016/0338502 | A1* | 11/2016 | Markowitz | B60N 2/60 |
| 2017/0156518 | A1* | 6/2017 | Hodes | A47G 9/062 |

* cited by examiner

SLIP COVER FOR AN OUTDOOR, COLLAPSIBLE CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessories for chairs, more specifically, a cover for a chair that converts into a blanket.

SUMMARY OF INVENTION

The slip cover for an outdoor collapsible chair is adapted for use with a chair. Specifically, the slip cover for an outdoor collapsible chair is intended for use with a camping or other outdoor chair. The slip cover for an outdoor collapsible chair is designed to drape over a chair in a manner that provides a top surface upon which the user can sit. The slip cover for an outdoor collapsible chair is further designed to be able to be folded on to the user. Optionally, the slip cover for an outdoor collapsible chair can further comprises a plurality of pockets such that when the slip cover for an outdoor collapsible chair is folded on the user the plurality of pockets are accessible. As a further option, the slip cover for an outdoor collapsible chair can be formed from a water resistant insulated textiles that is suitable for blankets.

These together with additional objects, features and advantages of the slip cover for an outdoor collapsible chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the slip cover for an outdoor collapsible chair in detail, it is to be understood that the slip cover for an outdoor collapsible chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the slip cover for an outdoor collapsible chair.

It is therefore important that the claims be regarded as including such equivalent construction insofar as they do not depart from the spirit and scope of the slip cover for an outdoor collapsible chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
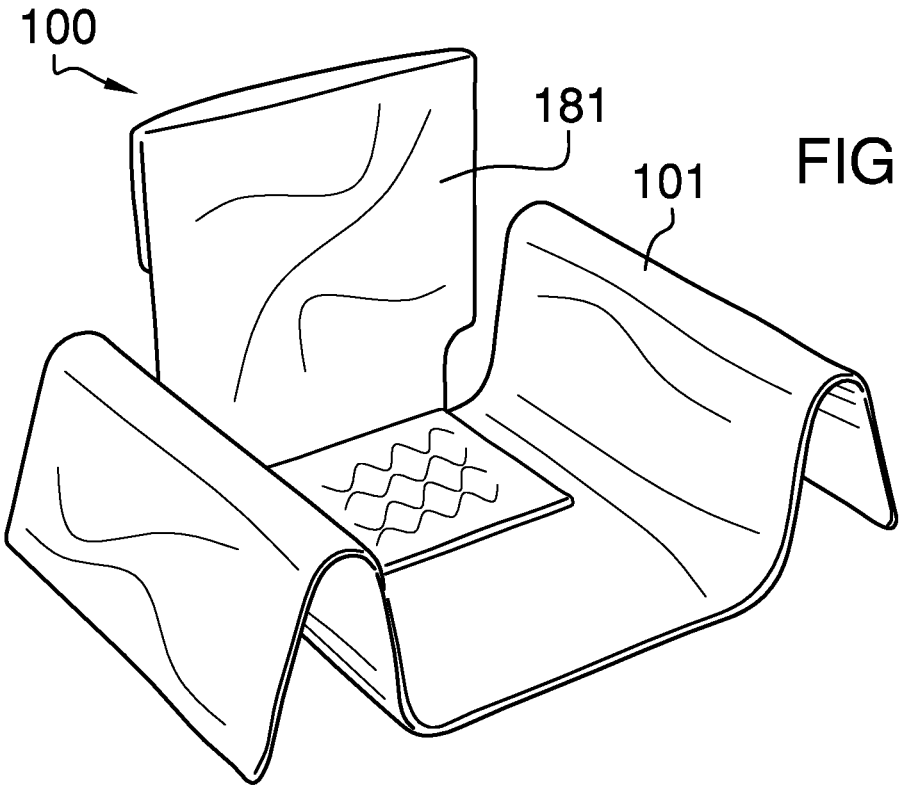
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The slip cover for an outdoor collapsible chair 100 (hereinafter invention) further comprises a plurality of panels 101 and a plurality of sewn seams 102. The invention 100 is adapted for use with a chair 105. Specifically, the invention 100 is intended for use with a camping or other outdoor chair 105. The invention 100 is designed to drape over a chair 105 in a manner that provides a top surface 181 upon which the user can sit. The invention 100 is further designed to be able to be folded on to the user. Optionally, the invention 100 can further comprises a first pocket 173 and second pocket 174 such that when the invention 100 is folded on the user the first pocket 173 and second pocket 174 are accessible. As a further option, the invention 100 can be formed from a water resistant insulated textile that is suitable for use as a blanket.

Each of the plurality of panels 101 is an individually cut textile. Each of the plurality of panels 101 are sewn together using a plurality of seams 102 such that the combination of the plurality of panels 101 forms the invention 100. The invention 100 is further defined with a top surface 181 and a bottom surface 182. The bottom surface 182 is the portion of the invention 100 that comes in contact with the chair 105 during use. The top surface 181 is the surface of the invention 100 that is distal from the bottom surface 182. Each of the plurality of panels 101 can also be defined with a top surface 181 and a bottom surface 182. The top surface 181 of each of the plurality of panels 101 is the surface that is contiguous with the top surface 181 of the invention 100.

The bottom surface 182 of each of the plurality of panels 101 is the surface that is distal from the top surface 181.

The plurality of panels 101 comprises a first panel 131, a second panel 132, a third panel 133, a fourth panel 134, a fifth panel 135, a sixth panel 136 a seventh panel 137, an eighth panel 138, and a ninth panel 139.

The first panel 131 is a textile cut in a rectangular shape. The first panel 131 is further defined with a first edge 141 and a second edge 142. The second panel 132 is a textile cut in a rectangular shape. In the first potential embodiment of the disclosure, the textile used to make the second panel 132 is a quilted material so that the second panel 132 is comfortable to sit on. The second panel 132 is further defined with a fifth edge 145, a sixth edge 146, a seventh edge 147 and an eighth edge 148. The third panel 133 is a textile cut in a rectangular shape. The third panel 133 is further defined with a twelfth edge 152 and a thirteenth edge 153. The fourth panel 134 is a textile cut in a rectangular shape. The fourth panel 134 is further defined with a third edge 143 and a fourth edge 144. The fifth panel 135 is a textile cut in a rectangular shape. The fifth panel 135 is further defined with a ninth edge 149, a tenth edge 150 and an eleventh edge 151.

The sixth panel 136 is a textile cut in a rectangular shape. The sixth panel 136 is further defined with a fourteenth edge 152 and a fifteenth edge 155. The seventh panel 137 is a textile cut in a rectangular shape with a first cut out 171 and a second cut out 172 removed. The seventh panel 137 is further defined with a sixteenth edge 156, a twenty third edge 163 and a twenty fourth edge 164. The first cut out 171 is a small rectangular segment removed from the seventh panel at the corner of the sixteenth edge 156 and the twenty third edge 163. The second cut out 172 is a small rectangular segment removed from the seventh panel 137 at the corner of the sixteenth edge 156 and the twenty third edge 163. The eighth panel 138 is a textile cut in a rectangular shape. The eight panel 138 is sewn on the bottom surface 182 of the first panel 131 to form the first pocket 173. The eighth panel 138 is further defined with a seventeenth edge 157, an eighteenth edge 158, and a nineteenth edge 159. The ninth panel 139 is a textile cut in a rectangular shape. The ninth panel 139 is sewn on the bottom surface 182 of the third panel 133 to form the second pocket 174. The ninth panel 139 is further defined with a twentieth edge 160, a twenty first edge 215, and a twenty second edge 162.

The plurality of sewn seams 102 further comprises a first sewn seam 111, a second sewn seam 112, a third sewn seam 113, a fourth sewn seam 114, a fifth sewn seam 115, a sixth sewn seam 116 a seventh sewn seam 117, an eighth sewn seam 118, a ninth sewn seam 119, a tenth sewn seam 120, an eleventh sewn seam 121, a twelfth sewn seam 122, a thirteenth sewn seam 123, and a fourteenth sewn seam 124.

Figure 2:
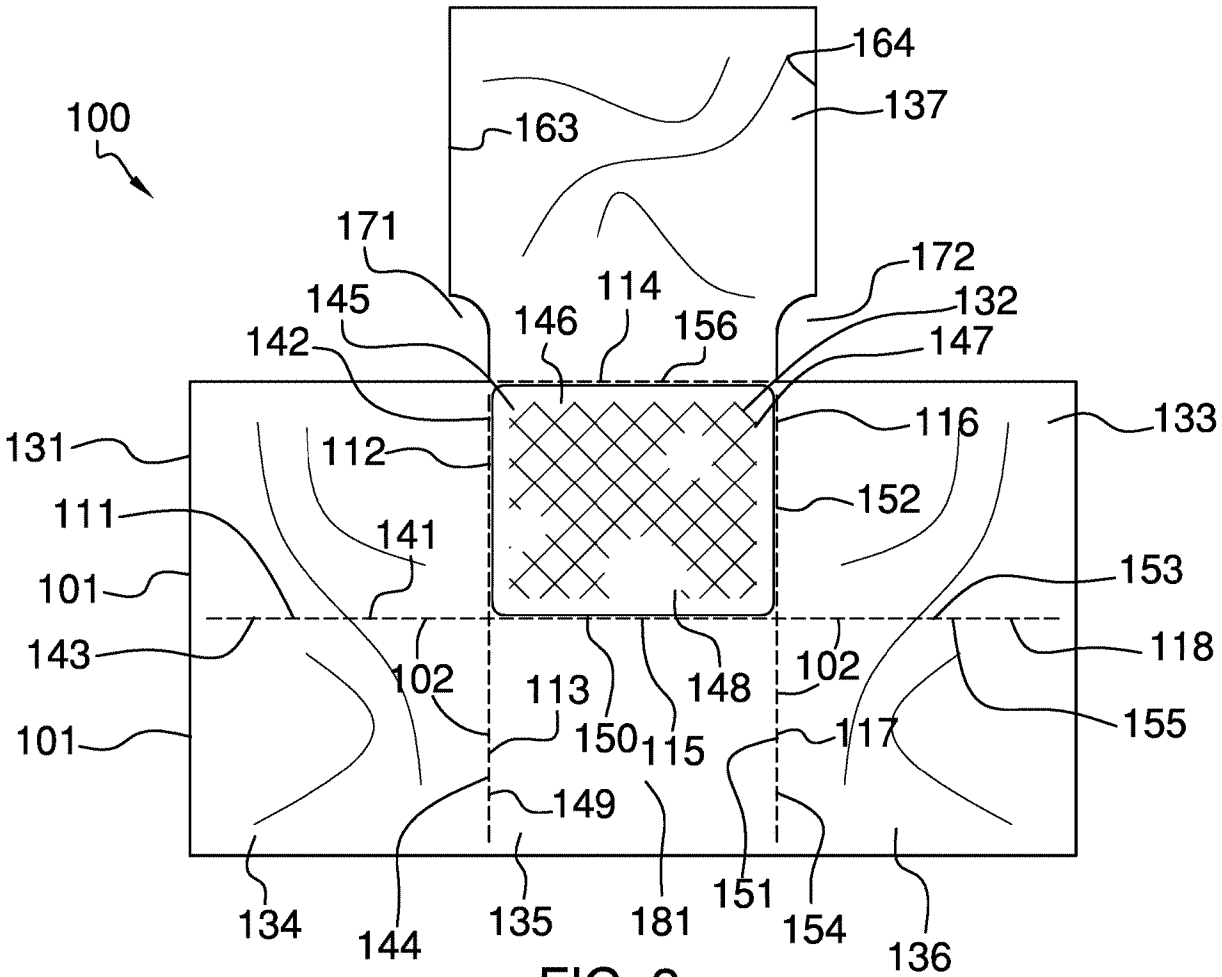
FIG. 2 is a top view of an embodiment of the disclosure.
Figure 3:
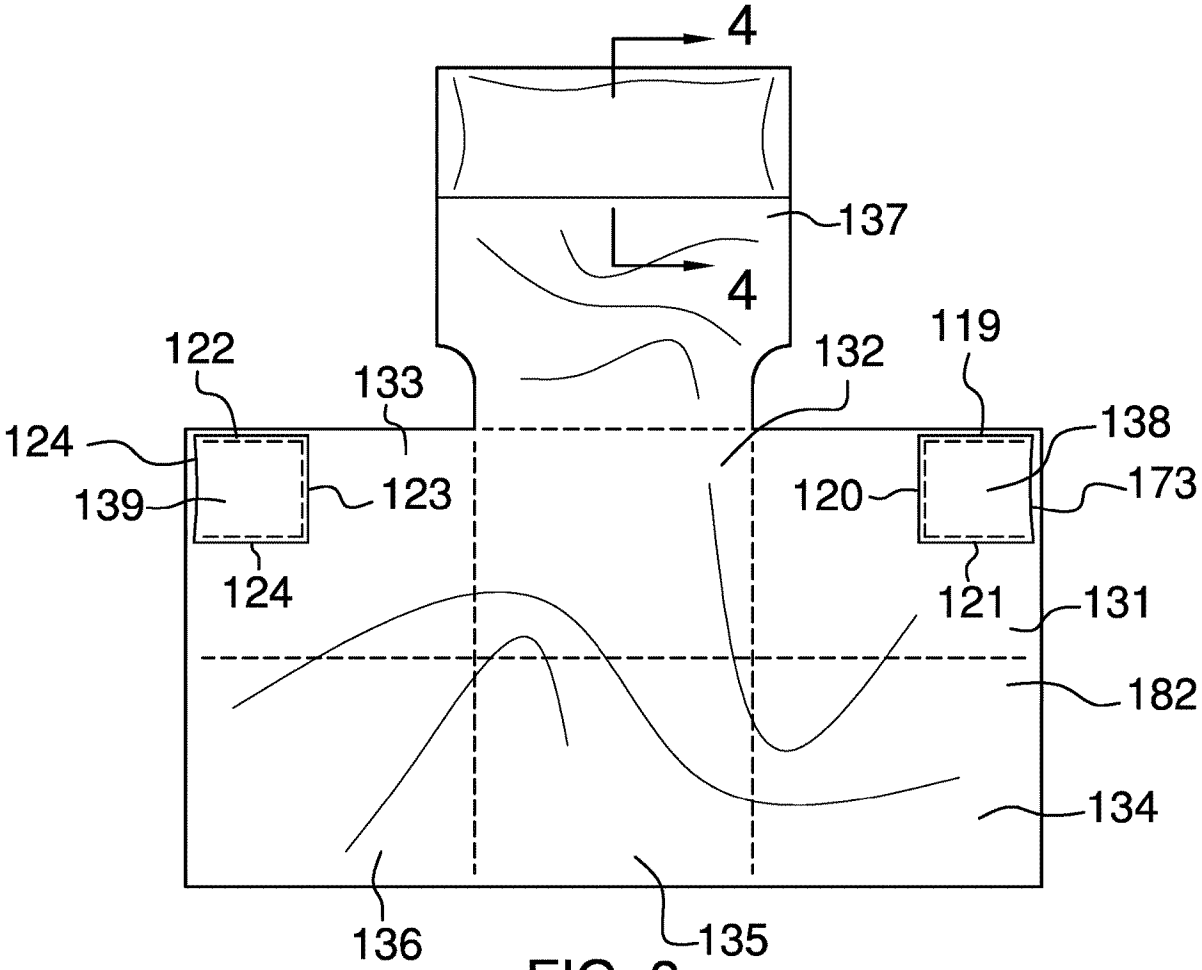
FIG. 3 is a bottom view of an embodiment of the disclosure.
Figure 4:
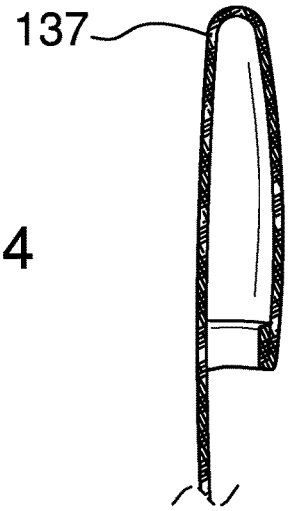
FIG. 4 is a cross-sectional view of an embodiment of the disclosure across 4-4 as shown in FIG. 3.
Figure 5:
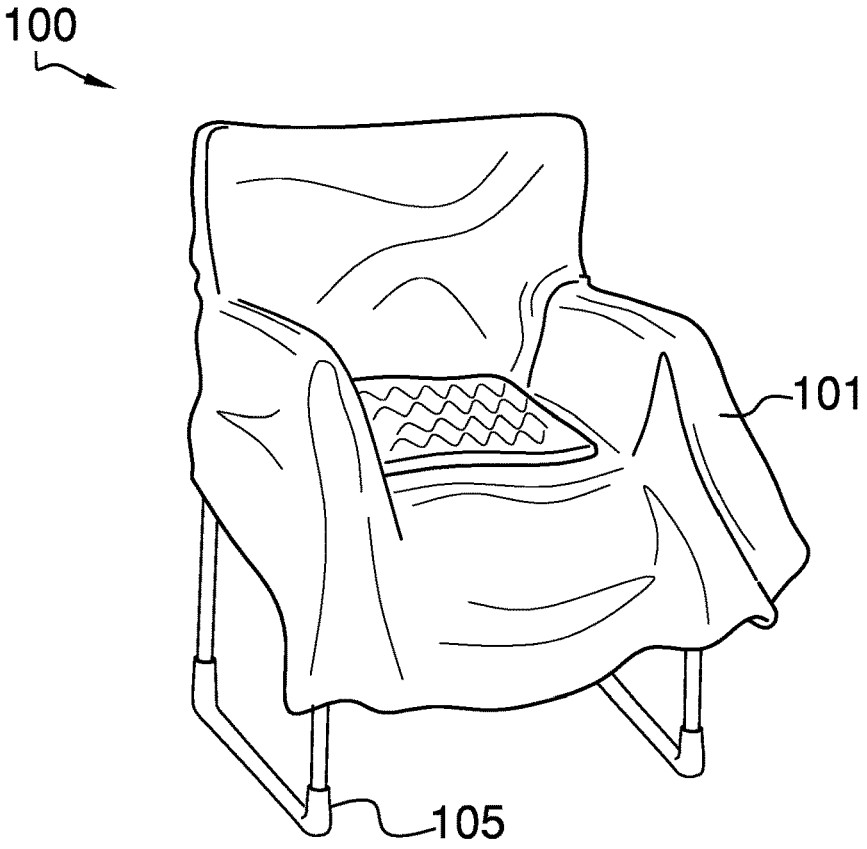
FIG. 5 is an in use view of an embodiment of the disclosure.

As most clearly shown in FIG. 2, the invention 100 is assembled as described in this paragraph. The first sewn seam 111 is a sewn seam that joins the first edge 141 to the third edge 143. The second sewn seam 112 is a sewn seam that joins the second edge 142 to the fifth edge 145. The third sewn seam 113 is a sewn seam that joins the fourth edge 144 to the ninth edge 149. The fourth sewn seam 114 is a sewn seam that joins the sixth edge 146 to the sixteenth edge 156. The fifth sewn seam 115 is a sewn seam that joins the eighth edge 148 to the tenth edge 150. The sixth sewn seam 116 is a sewn seam that joins the seventh edge 147 to the twelfth edge 152.

The seventh sewn seam 117 is a sewn seam that joins the eleventh edge 151 to the fourteenth edge 154. The eighth sewn seam 118 is a sewn seam that joins the thirteenth edge 153 to the fifteenth edge 155. The ninth sewn seam 119 is a sewn seam that joins the seventeenth edge 157 to the eighth panel 138 to form the first pocket 173. The tenth sewn seam 120 is a sewn seam that joins eighteenth edge 158 to the eighth panel 138 to form the first pocket 173. The eleventh sewn seam 121 is a sewn seam that joins the nineteenth edge 159 to the eighth panel 138 to form the first pocket 173. The twelfth sewn seam 122 is a sewn seam that joins the twentieth edge 160 to the ninth panel 139 to form the second pocket 174. The thirteenth sewn seam 123 is a sewn seam that joins the twenty first edge 161 to the ninth panel 139 to form the second pocket 174. The fourteenth sewn seam 124 is a sewn seam that joins the twenty second edge 162 to the ninth panel 139 to form the second pocket 174.

To use the invention 100, the bottom surface 182 of the second panel 132 is placed in the seat of the chair 105 such that the seventh panel 137 can be folded over the back 107 of the chair 105. From this position, the first panel 131 can be folded over the arm 106 of the chair 105 and the third panel 133 can be folded over the arm 106 of the chair 105. The user then sits normally in the chair 105. Should the user desire, the user can fold the first panel 131, the third panel 133, the fourth panel 134, and the sixth panel 136 on to themselves thereby using these panels as a blanket. In this position, the first pocket 173 and the second pocket 174 are readily accessible for use as hand warmers.

The textiles used to form the plurality of panels 101 are readily and commercially available. Methods to sew the sewn seams are well known and documented in the textile arts. It is preferred that the textile used in the formation of the plurality of panels 101 be a water resistant insulating material suitable for use as a blanket. It is preferred that each of the plurality of sewn seams 102 are French seams.

The following definitions were used in this disclosure:

Textile: As used in this disclosure, a textile is a material that is woven, knitted, braided or felted. Synonyms in common usage for this definition include fabric and cloth.

Sewn Seam: As used in this disclosure, a sewn seam a method of attaching two or more layers of textile, leather, or other material through the use of a thread, a yarn, or a cord that repeatedly inserted and looped through the two or more layers of textile, leather, or other material.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

We claim:

1. An accessory for furniture comprising:

a plurality of panels and a plurality of sewn seams;

wherein the accessory for furniture is adapted as a covering;

wherein the accessory for furniture is draped over a chair;

wherein the accessory for furniture is adapted to be folded on to a user;

wherein each of the plurality of panels is an individually cut textile;

wherein each of the plurality of panels is further defined with a top surface and a bottom surface;

wherein each of the plurality of panels are sewn together using a plurality of seams to form the accessory for furniture;

wherein the plurality of panels comprises a first panel, a second panel, a third panel, a fourth panel, a fifth panel, a sixth panel, and a seventh panel;

wherein the plurality of sewn seams comprises a first sewn seam, a second sewn seam, a third sewn seam, a fourth sewn seam, a fifth sewn seam, a sixth sewn seam a seventh sewn seam, and an eighth sewn seam;

wherein the first panel is a textile cut in a rectangular shape;

wherein the first panel is further defined with a first edge and a second edge;

wherein the third panel is a textile cut in a rectangular shape;

wherein the third panel is further defined with a twelfth edge and a thirteenth edge;

wherein the fourth panel is a textile cut in a rectangular shape;

wherein the fourth panel is further defined with a third edge and a fourth edge;

wherein the fifth panel is a textile cut in a rectangular shape;

wherein the fifth panel is further defined with a ninth edge, a tenth edge and an eleventh edge;

wherein the sixth panel is a textile cut in a rectangular shape;

wherein the sixth panel is further defined with a fourteenth edge and a fifteenth edge;

wherein the first sewn seam is a sewn seam that joins the first edge to the third edge;

wherein the third sewn seam is a sewn seam that joins the fourth edge to the ninth edge;

wherein the seventh sewn seam is a sewn seam that joins the eleventh edge to the fourteenth edge;

wherein the eighth sewn seam is a sewn seam that joins the thirteenth edge to the fifteenth edge;

wherein the second panel is a textile cut in a rectangular shape;

wherein the textile used to make the second panel is a quilted material;

wherein the second panel is further defined with a fifth edge, a sixth edge, a seventh edge and an eighth edge;

wherein the second sewn seam is a sewn seam that joins the second edge to the fifth edge;

wherein the fifth sewn seam is a sewn seam that joins the eighth edge to the tenth edge;

wherein the sixth sewn seam is a sewn seam that joins the seventh edge to the twelfth edge;

wherein the seventh panel is a textile cut in a rectangular shape;

wherein the seventh panel is further formed with a first cut out and a second cut out;

wherein the seventh panel is further defined with a sixteenth edge, a twenty third edge and a twenty fourth edge;

wherein the first cut out is a textile segment removed from the seventh panel at the corner of the sixteenth edge and the twenty third edge;

wherein the second cut out is a textile segment removed from the seventh panel at the corner of the sixteenth edge and the twenty third edge.

2. The accessory for furniture according to claim 1 wherein the fourth sewn seam is a sewn seam that joins the sixth edge to the sixteenth edge.

3. The accessory for furniture according to claim 2 wherein the accessory for furniture comprises a first pocket;

wherein the plurality of panels further comprises an eighth panel.

4. The accessory for furniture according to claim 3 wherein the plurality of sewn seams further comprises a ninth sewn seam, a tenth sewn seam, and an eleventh sewn seam.

5. The accessory for furniture according to claim 4 wherein the eighth panel is a textile cut in a rectangular shape;

wherein the eight panel is sewn on the bottom surface of the first panel to form the first pocket;

wherein the eighth panel is further defined with a seventeenth edge, an eighteenth edge, and a nineteenth edge.

6. The accessory for furniture according to claim 5 wherein the ninth sewn seam is a sewn seam that joins the seventeenth edge to the eighth panel;

wherein the tenth sewn seam is a sewn seam that joins eighteenth edge to the eighth panel;

wherein the eleventh sewn seam is a sewn seam that joins the nineteenth edge to the eighth panel.

7. The accessory for furniture according to claim 6 wherein the accessory for furniture comprises a second pocket;

wherein the plurality of panels further comprises an ninth panel.

8. The accessory for furniture according to claim 7 wherein the plurality of sewn seams further comprises a twelfth sewn seam, a thirteenth sewn seam, and a fourteenth sewn seam.

9. The accessory for furniture according to claim 8 wherein the ninth panel is a textile cut in a rectangular shape;

wherein the ninth panel is sewn on the bottom surface of the third panel;

wherein the ninth panel is further defined with a twentieth edge, a twenty first edge, and a twenty second edge;

wherein the twelfth sewn seam is a sewn seam that joins the twentieth edge to the ninth panel;

wherein the thirteenth sewn seam is a sewn seam that joins the twenty first edge to the ninth;

wherein the fourteenth sewn seam is a sewn seam that joins the twenty second edge to the ninth panel.

10. The accessory for furniture according to claim 9 wherein the textile that forms the first panel is a water resistant insulating material;

wherein the textile that forms the second panel is a water resistant insulating material;

wherein the textile that forms the third panel is a water resistant insulating material;

wherein the textile that forms the fourth panel is a water resistant insulating material;

wherein the textile that forms the fifth panel is a water resistant insulating material;

wherein the textile that forms the sixth panel is a water resistant insulating material;

wherein the textile that forms the seventh panel is a water resistant insulating material.

11. The accessory for furniture according to claim 10 wherein the first sewn seam is a French seam;

wherein the second sewn seam is a French seam;

wherein the third sewn seam is a French seam;

wherein the fourth sewn seam is a French seam;
wherein the a fifth sewn seam is a French seam;
wherein the sixth sewn seam is a French seam;
wherein the seventh sewn seam is a French seam;
wherein the eighth sewn seam is a French seam.

* * * * *